US009421556B2

(12) United States Patent
Moreira Da Costa et al.

(10) Patent No.: US 9,421,556 B2
(45) Date of Patent: Aug. 23, 2016

(54) DEPRESSANTS FOR MINERAL ORE FLOTATION

(71) Applicant: Kemira Oyj, Helsinki (FI)

(72) Inventors: Marcelo Moreira Da Costa, Barueri (BR); Jorge Eduardo Langsch, Barueri (BR); Paulo Henrique Morais, Barueri (BR); Lucas Moore, Marietta, GA (US)

(73) Assignee: Kemira Oyj, Helsinki (FI)

( * ) Notice: Subject to any disclaimer, the term of this patent is extended or adjusted under 35 U.S.C. 154(b) by 0 days.

(21) Appl. No.: 14/671,168

(22) Filed: Mar. 27, 2015

(65) Prior Publication Data

US 2015/0196926 A1 Jul. 16, 2015

Related U.S. Application Data

(63) Continuation of application No. PCT/US2013/062847, filed on Oct. 1, 2013.

(60) Provisional application No. 61/708,222, filed on Oct. 1, 2012.

(51) Int. Cl.

| | |
|---|---|
| ***B03D 1/016*** | (2006.01) |
| ***B03D 1/02*** | (2006.01) |
| *B03D 1/012* | (2006.01) |

(52) U.S. Cl.

CPC ..... *B03D 1/016* (2013.01); *B03D 1/02* (2013.01); *B03D 1/012* (2013.01); *B03D 2201/06* (2013.01); *B03D 2203/02* (2013.01)

(58) Field of Classification Search

None

See application file for complete search history.

(56) References Cited

U.S. PATENT DOCUMENTS

| | | | | |
|---|---|---|---|---|
| 2,934,208 | A * | 4/1960 | Schoeld | B03D 1/016 209/166 |
| 3,844,412 | A * | 10/1974 | Robert | B03D 1/06 209/166 |
| 4,181,796 | A | 1/1980 | Dietrichs et al. | |
| 4,808,301 | A | 2/1989 | Hansen et al. | |
| 4,853,114 | A * | 8/1989 | Lewis | B03D 1/016 209/167 |
| 7,311,206 | B1 | 12/2007 | Svensson et al. | |
| 2014/0061101 | A1* | 3/2014 | Silva | B03D 1/018 209/166 |

FOREIGN PATENT DOCUMENTS

| | | |
|---|---|---|
| GB | 1230166 | 4/1971 |

OTHER PUBLICATIONS

Sun, J.X. et al, "Fractional extraction and structural charachterization of sugarcane bagasse hemiculloses", Mar. 2004, Elsevier, Carbohydrate Polymers, vol. 56, pp. 195-204.*

International Search Report for International Patent Application No. PCT/US2013/062847, issued Mar. 6, 2014.

* cited by examiner

*Primary Examiner* — Thomas M Lithgow

(74) *Attorney, Agent, or Firm* — King & Spalding

(57) ABSTRACT

Depressants comprising one or more types of polysaccharides comprising one or more types of pentosan units are provided. Also disclosed are processes for enriching a desired mineral from an ore comprising the desired mineral and gangue, wherein the process comprises carrying out a flotation process in the presence of one or more collecting agents and one or more of the depressants.

7 Claims, 4 Drawing Sheets

DEPRESSANTS FOR MINERAL ORE FLOTATION

CROSS REFERENCE TO RELATED APPLICATION

This application is a continuation of International Application No. PCT/US2013/062847, filed Oct. 1, 2013, which claims priority to U.S. Provisional Application No. 61/708,222, filed Oct. 1, 2012.

FIELD OF THE ART

The present disclosure generally relates to depressants for use in mineral ore flotation processes.

BACKGROUND

In the processing of mineral-containing ores, it is necessary to separate undesirable minerals known as gangue (e.g. $Al_2O_3$, $SiO_2$ and $TiO_2$) from the desired minerals in ore (e.g. iron ore). One method of accomplishing this goal is to depress the flotation of a particular mineral during the normal flotation process. In mineral flotation systems, it is common to depress the gangue materials while floating the desirable mineral or minerals. In differential or reverse flotation systems, it is common to depress the desired mineral or minerals while floating the gangue. Depression is conventionally accomplished by the use of one or more depressing agents (also known as depressants) during the flotation step. The depressant, when added to the flotation system, exerts a specific action on the material to be depressed thereby preventing it from floating. The ability of the depressant to facilitate such separation is referred to as its selectivity, i.e. a more selective depressant achieves better separation of the gangue from the desired minerals.

In a typical ore flotation scheme, the ore is ground to a size sufficiently small to liberate the desired mineral or minerals from the gangue. An additional step in the flotation process involves the removal of the ultra-fine particles by desliming. Ultra-fine particles are generally defined as those less than 5 to 10 microns in diameter. The desliming process may be accompanied by or followed by a flocculation step or some other type of settling step such as the use of a cyclone separating device. This step is followed by a flotation step wherein gangue materials are separated from the desired mineral or minerals in the presence of collectors and/or frothers.

It has been conventional in many flotation systems to use naturally derived substances such as starches, dextrins and gums as depressants. In some countries, there is a prohibition against using substances such as starch which have food value in this type of commercial application.

Starch, or causticized starch, is commonly used as a depressant in reverse iron ore flotation processes. Native starch is typically digested with sodium hydroxide or boiling water before use in such applications, see for example Tang et al. "The Acidity of Caustic Digested Starch and Its Role in Starch Adsorption on Mineral Surfaces" *International Journal of Mineral Processing* (2012), doi: 10.1016/j.minpro.2012.06.001. Starch produces relatively small but robust flocs which can be further upgraded by washing.

Large quantities of starch are consumed as a result of its use as a depressant in flotation processes. For example, Brazilian iron ore pellet feed production in 2010 was approximately 73,000,000 Tons, which consumed approximately 50,000 Tons of starch as the depressant. Depressant consumption is expected to increase at least 4-fold by 2017.

BRIEF SUMMARY

Depressants comprising one or more types of polysaccharides comprising one or more types of pentosan units, and compositions comprising the depressants and a solvent, are provided. Also disclosed herein are processes for enriching a desired mineral from an ore comprising the desired mineral and gangue, wherein the process comprises carrying out a flotation process in the presence of one or more collecting agents and one or more of the depressants.

The disclosure may be understood more readily by reference to the following detailed description of the various features of the disclosure and the examples included therein.

DETAILED DESCRIPTION

Figure 1:
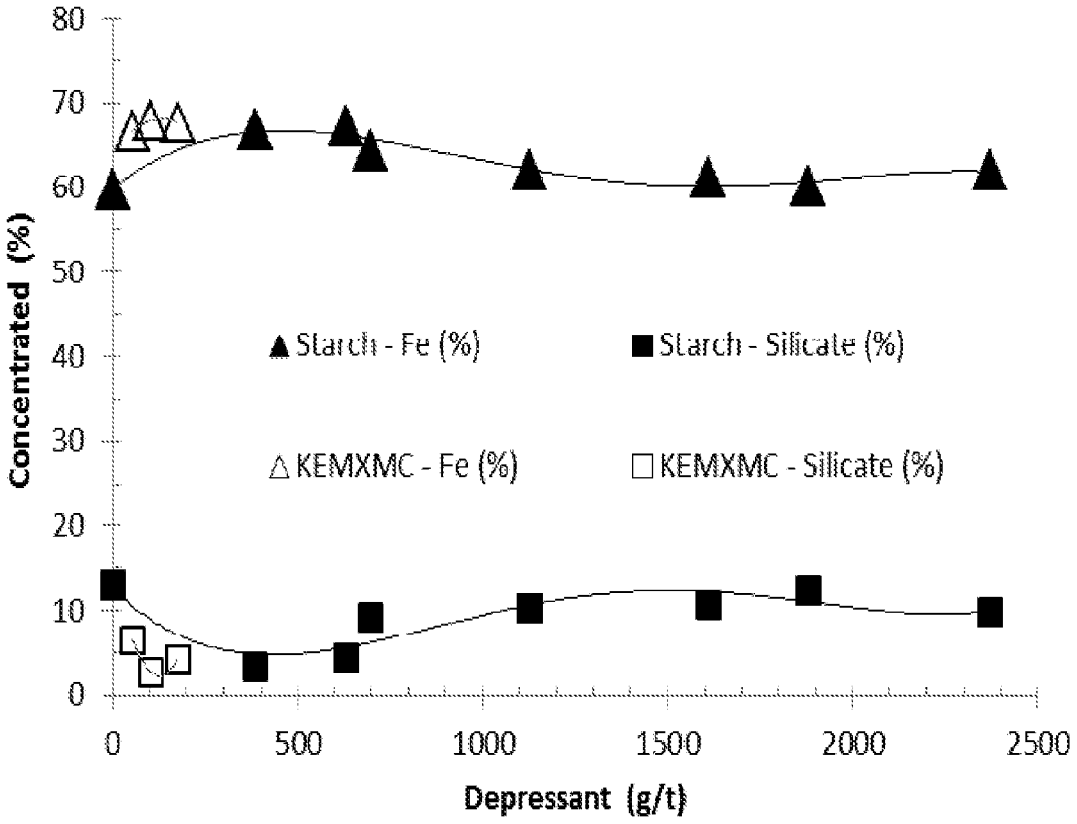
FIG. 1 is graph of the iron and silicate content in the fraction concentrate for processes using an exemplary depressant (KEMXMC) and starch.

According to the various exemplary embodiments described herein, depressants and related compositions and processes may be used to process mineral-containing ore to separate gangue from desired minerals. Exemplary depressants comprise one or more types of polysaccharides comprising one or more types of pentosan units. The depressants, compositions and processes may provide improved selectivity compared to other depressants such as starch or causticized starch. In particular, the depressants may provide increased flotation process selectivity, decreased collector consumption, decreased sodium hydroxide consumption, and/or decreased landfill, as compared to starch-based depressants. The exemplary depressants also offer an advantage over starch-based depressants because they do not have food value. In exemplary embodiments, the depressants may be provided in a form which renders them easier to dilute and/or directly apply, for example in gel form.

DEFINITIONS

As used herein, a "depressant" refers to an agent that depresses the flotation of the desired minerals in preference to depressing the flotation of the associated gangue.

As used herein, the "desired minerals" refers to minerals which have value and may be extracted from ore which contains the desired mineral and gangue. Examples of desired minerals include iron powder, hematite, magnetite, pyrite, chromite, goethite, marcasite, limonite, pyrrohotite or any other iron-containing minerals.

As used herein, "gangue" refers to the undesirable minerals in a material that contains both undesirable and desired minerals, for example an ore deposit. Such undesirable minerals may include oxides of aluminum, silica (e.g.

quartz), titanium, sulfur and alkaline earth metals. In certain embodiments, the gangue includes oxides of silica, silicates or siliceous materials.

As used herein, the term "polysaccharide" refers to carbohydrate molecules of repeated monomer (monosaccharide) units joined together by glycosidic bonds. The polysaccharide may vary in structure, for example, may be linear or branched. The molecules may contain slight modifications of the repeating unit. Monosaccharides are generally aldehydes or ketones with two or more hydroxyl groups. A polysaccharide containing a single type of monosaccharide unit is referred to as a homopolysaccharide, while a polysaccharide containing more than one type of monosaccharide unit is referred to as a heteropolysaccharide. Polysaccharides are generally considered to contain ten or more monosaccharide units, while the term "oligosaccharide" is generally used to refer to the polymers containing a small number, e.g. two to ten, of monosaccharide units.

As used herein, the term "starch" refers to a carbohydrate consisting of a large number of glucose units joined by glycosidic bonds. It is well established that starch polymer consists mainly of two fractions, amylose and amylopectin, which vary with the source of starch. The amylose having a low molecular weight contains one end group per 200-300 anhydroglucose units. Amylopectin is of higher molecular weight and consists of more, than 5,000 anhydroglucose units with one end group for every 20-30 glucose units. While amylose is a linear polymer having $\alpha 1 \rightarrow 4$ carbon linkage, amylopectin is a highly branched polymer with $\alpha 1 \rightarrow 4$ and $\alpha 1 \rightarrow 6$ carbon linkages at the branch points.

As used herein, "ore" refers to rocks and deposits from which the desired minerals can be extracted. Other sources of the desired minerals may be included in the definition of "ore" depending on the identity of the desired mineral. The ore may contain undesirable minerals or materials, also referred to herein as gangue.

As used herein, "iron ore" refers to rocks, minerals and other sources of iron from which metallic iron can be extracted. The ores are usually rich in iron oxides and vary in color from dark grey, bright yellow, deep purple, to rusty red. The iron itself is usually found in the form of magnetite ($Fe_3O_4$), hematite ($Fe_2O_3$), goethite (FeO(OH)), limonite (FeO(OH).n($H_2O$)), siderite ($FeCO_3$) or pyrite ($FeS_2$). Taconite is an iron-bearing sedimentary rock in which the iron minerals are interlayered with quartz, chert, or carbonate. Itabirite, also known as banded-quartz hematite and hematite schist, is an iron and quartz formation in which the iron is present as thin layers of hematite, magnetite, or martite. Any of these types of iron are suitable for use in processes described herein. In exemplary embodiments, the iron ore is substantially magnetite, hematite, taconite or itabirite. In exemplary embodiments, the iron ore is substantially pyrite. In exemplary embodiments, the iron ore is contaminated with gangue materials, for example oxides of aluminum, silica or titanium. In exemplary embodiments, the iron ore is contaminated with clay.

Depressants

The exemplary embodiments include a depressant having one or more types of polysaccharides comprising one or more types of pentosan units. Exemplary pentosan units are monosaccharides having five carbon atoms, including, for example, xylose, ribose, arabinose, and lyxose. In exemplary embodiments, the pentosan unit may be an aldopentose, which has an aldehyde functional group at position 1, such as, for example, the D- or L-forms of arabinose, ribose, xylose and lyxose. Exemplary polysaccharides include, for example, xylan, hemicellulose, and gum arabic. Exemplary hemicellulose is derived from biomass, for example grasses and wood, such as hardwood. In exemplary embodiments, the hemicellulose may contain mixtures of xylose, arabinose, mannose and galactose. Exemplary gum arabic may contain arabinose and ribose. In exemplary embodiments, the one or more types of pentosan units comprises xylan units and one or more of hemicellulose and aldopentoses. In exemplary embodiments, the one or more types of polysaccharides are derived from plant cell walls, for example sugar-cane- or corn-plant cell walls, or algae. In exemplary embodiments, the one or more types of polysaccharides are derived from sugar cane, fiber cane, or corn. In exemplary embodiments, the one or more types of polysaccharides are derived from sugar cane bagasse. In exemplary embodiments, the one or more types of polysaccharides are derived from corn fiber residue. In exemplary embodiments, the depressant may be a blend or a mixture of polysaccharides having one or more types of pentosan units. In certain embodiments, the depressant may consist essentially of polysaccharides comprising one type of pentosan unit, for example xylan. In certain embodiments, the one or more types of pentosan units comprise xylan. In exemplary embodiments, a depressant is provided that includes one or more types of polysaccharides comprising xylan units.

In exemplary embodiments, a polysaccharide comprising xylan may be extracted from plant material or from algae with dilute alkaline solutions. In exemplary embodiments, the polysaccharide comprising xylan may be extracted from sugar cane bagasse or corn fiber residue with dilute alkaline solutions.

Xylan is an oligosaccharide which could be extracted in the form of 5 to 200 anhydroxylose units consisting of D-xylose units with $1\beta \rightarrow 4$ linkages.

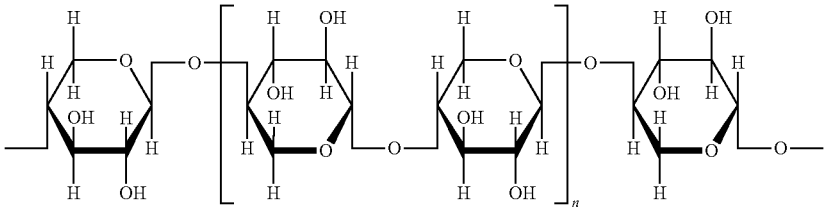

Xylan oligosaccharide with 5 to 200 anhydroxylose units consisting of D-xylose units with 1β→4 linkages In exemplary embodiments, the polysaccharides comprising one or more types of pentosan unit may be extracted from the pulping black liquors, from the cold caustic extraction (CCE) filtrates, and/or from acid pre-hydrolyzes or auto-hydrolyzes process in order to achieve dissolve pulp grades. Such extractions are described in, for example, Jayapal et al. *Industrial Crops and Products* 2012, v. 42, pp. 14-24; Muguet et al. *Holzforschung* 2011, v. 65, pp. 605-612; and Gehmayer et al. Biomacromolecules 2012, v. 13, pp. 645-651.

In exemplary embodiments, the depressants are not substantially digestible or are not suitable for human consumption. In certain embodiments, the depressants do not comprise substantial amounts of arabinose or ribose or sources thereof.

In exemplary embodiments, the depressant may have any molecular weight so long as the depressant has the effect of depressing the flotation of the desired minerals in preference to depressing the flotation of the associated gangue. In exemplary embodiments, the depressant possesses essentially no flocculating properties. In exemplary embodiments, the molecular weight of the depressant is about 700 to about 50,000; about 700 to about 25,000; or about 700 to about 8000 Daltons. In exemplary embodiments, the molecular weight of the depressant is about 5 to about 300, about 5 to about 150, or about 5 to about 50 aldopentose units, for example xylose units.

According to the various exemplary embodiments, the amount of depressant to be used is that which will depress the flotation of the desired mineral ore or ores to a necessary or desired extent. The amount of depressant needed will depend, at least in part, on a number of factors such as the desired mineral and gangue to be separated and the conditions of the flotation process. In exemplary embodiments, the amount of depressant used in the flotation process is about 0.01 to about 1.5 kilogram, or about 0.2 to about 0.7 kg of depressant per metric ton of ore to be floated. In exemplary embodiments, the specific consumption of depressant in the processes is about 0.01 to about 1.5 kilogram, or about 0.2 to about 0.7 kg of depressant per metric ton of ore to be floated.

According to the exemplary embodiments, the depressants may be used alone, or may be used in a flotation process with other depressants. Other depressants which may be used in combination with the exemplary depressants include but are not limited to: starch; starch activated by treatment with alkali; cellulose esters, such as carboxymethylcellulose and sulphomethylcellulose; cellulose ethers, such as methyl cellulose, hydroxyethylcellulose and ethyl hydroxyethylcellulose; hydrophilic gums, such as gum arabic, gum karaya, gum tragacanth and gum ghatti, alginates; starch derivatives, such as carboxymethyl starch and phosphate starch; and combinations thereof.

The exemplary depressants are generally useful as depressants in mineral flotation. In particular, the exemplary depressants are effective in selectively depressing the flotation of desired mineral(s) as compared to gangue. In certain embodiments, the exemplary depressants are used to enhance the separation of iron-containing minerals, such as iron oxides or iron powder, from silicate gangue by differentially depressing the flotation of the iron-containing minerals relative to that of the silicate gangue. One of the problems associated with the separation of iron-containing minerals from silicate gangue is that the iron-containing minerals and silicates both tend to float under certain processing conditions. The exemplary depressants may be used to change the flotation characteristics of the iron-containing minerals relative to silicate gangue, to improve the separation process.

According to the various embodiments, the amount of depression may be quantified. For example, a percent of depression may be calculated by measuring the weight percent of the particular mineral or gangue floated in the absence of any depressant and measuring the weight percent of the same mineral or gangue floated in the presence of a depressant. The latter value is subtracted from the former; the difference is divided by the weight percent floated without any depressant; and this value is multiplied by 100 to obtain the percent of depression. In exemplary embodiments, the percent of depression may be any amount that will provide a necessary or desired amount of separation to enable separation of the desirable minerals from gangue. In exemplary embodiments, use of the exemplary depressant causes the flotation of desirable minerals to be depressed by at least about 5%, about 10%, or about 12%. In exemplary embodiments, use of the depressant causes the flotation of the gangue to be depressed by less than about 7.5% or about 5%.

Compositions

In exemplary embodiments, a composition comprises a depressant and a solvent, wherein the depressant comprises one or more types of polysaccharides comprising one or more types of pentosan units. Exemplary depressants may be any depressant according to the embodiments described herein. In exemplary embodiments, the solvent is water.

In exemplary embodiments, the composition is a gel, for example a polysaccharide gel. In exemplary embodiments, the gel is water-soluble.

An exemplary composition may be formulated to provide a sufficient amount of depressant to a flotation process, i.e., an amount sufficient to produce a desired result.

In an exemplary embodiment, the composition may include one or more other depressants. In an exemplary embodiment, the composition may include one or more agents or modifiers. Examples of such agents or modifiers include, but are not limited to, frothers, activators, collecting agents, depressants, dispersants, acidic or basic addition agents, or any other agent known in the art.

Processes

According to exemplary embodiments, a flotation process may use the exemplary depressants described herein. As discussed above, flotation is a commonly used process for separating or concentrating desirable minerals from ore, for example iron from taconite. Flotation processes take advantage of the differences between the hydrophobicity of the desired minerals and that of the gangue to achieve separation of these materials. Such differences can be increased with the use of surfactants and flotation agents, including but not limited to collecting agents and depressants (also called depressing agents).

Generally, a flotation process may include the steps of grinding crushed ore, classifying the ground ore in water, treating the classified ore by flotation to concentrate one or more minerals in the froth while the remainder of the minerals of the ore remain in the water pulp, and collecting the minerals in the froth and/or pulp. Some of these steps are described in more detail below.

In exemplary embodiments, a flotation process comprises separating the gangue from the desirable mineral concentrate by floating the gangue in the froth and recovering the desirable mineral concentrate as the underflow. In other exemplary embodiments, a flotation process comprises separating the gangue from the desirable mineral concentrate by inducing the gangue to sink to the bottom of the cell (as underflow) and recovering the desirable mineral concentrate as the overflow (froth). In exemplary embodiments, the flotation process comprises separating iron concentrates from silica and other silaceous materials by flotation of the silica and recovering the iron concentrate as underflow.

In exemplary embodiments, a process for enriching a desired mineral from an ore having the desired mineral and gangue includes carrying out a flotation process in the presence of one or more collecting agents and one or more depressants. In exemplary embodiments, at least one of the one or more depressants comprises one or more types of polysaccharides comprising one or more types of pentosan units. In exemplary embodiments, at least one of the one or more depressants comprises one or more types of polysaccharides comprising xylan units.

In exemplary embodiments, the desired mineral is an iron-containing mineral, such as iron oxides or iron powder.

In exemplary embodiments, a process for enriching an iron-containing mineral from an ore having the iron-containing material and silicate-containing gangue, includes carrying out a flotation process in the presence of one or more collecting agents and one or more depressants. In exemplary embodiments at least one of the one or more depressants comprises one or more types of polysaccharides comprising one or more types of pentosan units. In exemplary embodiments, at least one of the one or more depressants comprises one or more types of polysaccharides comprising xylan units.

In exemplary embodiments, the flotation process is a reverse or inverted flotation process, for example a reverse cationic flotation process. In such processes, the flotation of the desired mineral is selectively depressed when compared to the flotation of the gangue so as to facilitate separation and recovery of the desired mineral.

In exemplary embodiments, the flotation process is a direct flotation process, for example a cationic or anionic flotation process.

In certain exemplary embodiments, the one or more depressants are added in the form of a composition comprising the depressant and a solvent.

In exemplary embodiments, the one or more depressants may be added at any stage of the process prior to the flotation step. In certain embodiments, the one or more depressants are added before or with the addition of the collecting agents.

In an exemplary process, various agents and modifiers may be added to the ore that is dispersed in water (flotation pulp), and air is introduced into the pulp to form a froth. The resulting froth contains those materials which are not wetted and have an affinity for air bubbles. Examples of such agents and modifiers include but are not limited to frothers, activators, collecting agents, depressants, dispersants, acidic or basic addition agents, or any other agent known in the art.

In exemplary embodiments, a collecting agent or collector may be added to the flotation pulp. Generally, collecting agents may form a hydrophobic layer on a given mineral surface in the flotation pulp, which facilitates attachment of the hydrophobic particles to air bubbles and recovery of such particles in the froth product. Any collecting agent may be used in the exemplary processes. The choice of collector will depend, at least in part, on the particular ore to be processed and on the type of gangue to be removed. Suitable collecting agents will be known to those skilled in the art. In exemplary embodiments, the collecting agents may be compounds comprising anionic groups, cationic groups or non-ionic groups. In certain embodiments, the collecting agents are surfactants, i.e. substances containing hydrophilic and hydrophobic groups linked together. Certain characteristics of the collecting agent may be selected to provide a selectivity and performance, including solubility, critical micelle concentration and length of carbonic chain.

Exemplary collecting agents include compounds containing oxygen and nitrogen, for example compounds with amine groups. In exemplary embodiments, the collecting agents may be selected from the group consisting of: ether amines, for example primary ether monoamines, and primary ether polyamine; aliphatic $C_8$-$C_{20}$ amines for example aliphatic amines derived from various petroleum, animal and vegetable oils, octyl amine, decyl amine, dodecyl amine, tetradecyl amine, hexadecyl amine, octadecyl amine, octadecenyl amine and octadecadienyl amine; quaternary amines for example dodecyl trimethyl ammonium chloride, coco trimethyl ammonium chloride, and tallow trimethyl ammonium sulfate; diamines or mixed amines for example tallow amine, hydrogenated tallow amine, coconut oil or cocoamine, soybean oil or soya-amine, tall oil amine, rosin amine, tallow diamine, coco diamine, soya diamine or tall oil diamines and the like, and quaternary ammonium compounds derived from these amines; amido amines and imidazolines such as those derived from the reaction of an amine and a fatty acid; and combinations or mixtures thereof. In an exemplary embodiment, the collecting agent is an ether amine or mixture of ether amines.

Exemplary collecting agents may be partially or wholly neutralized by a mineral or organic acid such as hydrochloric acid or acetic acid. Such neutralization facilitates dispersibility in water. In the alternative, the amine may be used as a free base amine by dissolving it in a larger volume of a suitable organic solvent such as kerosene, pine oil, alcohol, and the like before use. These solvents sometimes have undesirable effects in flotation such as reducing flotation selectivity or producing uncontrollable frothing. Although these collecting agents differ in structure, they are similar in that they ionize in solution to give a positively charged organic ion.

According to the exemplary embodiments, the quantity of collecting agent may vary over a wide range. The amount of collecting agent may depend, at least in part, upon the gangue content of the ore being processed. For example, ores having higher silica content may require greater quantities of collecting agents. In exemplary embodiments, about 0.01 to about 2 lbs., or about 0.1 to about 0.35 lbs., of collecting agent per ton of ore is used in the process.

In exemplary embodiments, one type of collecting agent is used in the process. In exemplary embodiments, two or more collecting agents are used in the process.

In exemplary embodiments, one or more frothing agents are used in the process. Exemplary frothing agents are heteropolar organic compounds which reduce surface tension by being absorbed at air-water interfaces and thus facilitate formation of bubbles and froth. Examples of frothing agents are methylisobutyl carbinol; alcohols having 6-12 carbon atoms which optionally are alkoxylated with ethylene oxide and/or propylene oxide; pine oil; cresylic acid; various alcohols and soaps. In exemplary embodiments, about 0.001 to 0.2 lb. of frothing agent per ton of ore are provided.

According to an exemplary embodiment, after completion of the flotation, a gangue-enriched flotate (froth), for example a silicate-enriched flotate, and a bottom fraction rich in the desired mineral (tailings, underflow), for example iron, are produced.

According to the embodiments, one or more steps may be done prior to the flotation step to prepare the ore for flotation. For example, in one step of the process, the ore can be ground, together with water, to the desired particle size, for example a particle size between about 5 and about 200 μm. Optionally, conditioning agents such as sodium hydroxide and/or sodium silicate may be added to the grinding mill prior to grinding the crude ore. In exemplary embodiment, sufficient water is added to the grinding mill to provide a slurry containing approximately 70% solids.

In exemplary processes, the ground ore may be deslimed. For example, the ground ore may be suspended in water, and fine material maybe deslimed, for instance, by filtration, settling, siphoning or centrifuging. In exemplary embodiments, the desliming step may be repeated one or more times.

In exemplary processes, an ore-water slurry may be prepared from the deslimed ore, and one or more depressants according to the embodiments may be added to the slurry. In exemplary embodiments, the one or more depressants are added in an amount of about 10 to about 1500 g per ton of ore. In exemplary embodiments, the ore-water slurry to transferred to a flotation cell and the one or more depressants are added to the ore water slurry in the flotation cell.

In exemplary embodiments, base or alkali may be added to adjust the pH of the slurry. For example, the slurry may be adjusted to a pH in the range of about 8 to about 11, or about 9 to about 11, or about 10 to about 11. In certain embodiments, the pH is adjusted to about 10.5. In exemplary embodiments, the pH of the slurry in the flotation cell is maintained at between about 8 and about 11 for optimum iron recoveries.

According to the embodiments, in one step of the flotation process, one or more collecting agents may be added, for example after the addition of the one or more depressants and any other process agents.

In exemplary embodiments, once all of the processing agents have been added, the mixture is further conditioned or agitated for a period of time before the froth flotation is carried out. If desired, a froth-regulating means can be added on a convenient occasion before the froth flotation.

In exemplary embodiments, the flotation process may be performed in a plurality of flotation processing steps. For example, the flotation process may be performed in flotation units containing a plurality of communicating cells in series, with the first cell(s) being generally used for the rougher flotation, and subsequent cell(s) being used for the cleaner flotation. In exemplary embodiments, each flotation cell may be any flotation equipment, including, for example, the Denver laboratory flotation machine and/or the Wemco Fagergren laboratory flotation machine, in which the slurry mixture is agitated and air is injected near the bottom of the cell as desired.

In exemplary embodiments, before flotation treatment the ore-water slurry comprises about 20 to about 40% by weight solids. The duration of the flotation process depends upon the desired result. In exemplary embodiments, the time of flotation treatment may be from about 1 to 10 minutes for each circuit. The time of the flotation process may depend at least in part upon the gangue content, the grain size of the ore being treated and the number of flotation cells involved.

According to the embodiments, in the rougher flotation treatment, the gangue may be selectively separated from the ore and removed with the flotation froth. The desired mineral concentrate from the flotation treatment is removed as the underflow and isolated as the rougher concentrate. In exemplary embodiments, the concentrate of the desirable mineral in the rougher concentrate is found to contain a sufficiently low quantity of gangue to be suitable for almost any desired use.

In exemplary embodiments, the flotation froth, the rougher concentrate, or both may be further processed. For example, in exemplary embodiments, the overflow or froth from the rougher flotation may be advanced to a first cleaner flotation cell where a second flotation treatment is performed. The underflow from this first cleaning flotation cell is an mineral concentrate identified as the first cleaner middlings which generally will contain more gangue than the rougher concentrate but significantly less gangue than the original crude ore. The overflow frothing from the first cleaning cell may be advanced to a second cleaning flotation cell where the flotation procedure is repeated and another mineral concentrate is obtained which is identified as the second cleaner middlings. In exemplary embodiments, the froth flotation cleaning is repeated one or more times. Any or all of the cleaner middlings may be combined with a rougher concentrate to provide an upgraded mineral ore concentrate. The extent to which the rougher concentrate is combined with the various middling fractions will depend upon the desired mineral content of the final product derived from the procedure. As an alternative embodiment, the cleaner middlings may be returned and recycled through the rougher flotation cell to further upgrade these cleaner middlings.

The depressants, compositions and processes of the exemplary embodiments can be used to provide higher selectivity and desired mineral recoveries as compared to other depressants when used in cationic flotation processes. In exemplary embodiments, the mineral concentrate, e.g. hematite concentrate, that is obtained by the exemplary processes meets the specifications for the steel industry. In exemplary embodiments, the depressants, compositions and processes can be used to maximize the iron recovery to increase production of metallic charge per unit ore fed, which may provide increases in production and profitability.

The following examples are presented for illustrative purposes only, and are not intended to be limiting.

EXAMPLES

General Protocol for Flotation Tests

Flotation tests described herein were generally performed with iron pulp samples according to the following procedure:

1) The pulp is filtered using a vacuum pump and filtration kit (Kitazato flask, Buchner funnel and filter paper white ribbon).

2) The volume of liquid filtered is measured and recorded.

3) The filtered liquid is transferred to a bottle suitable for further analysis of iron by wet chemistry and the silicate was determinate as the mass of insoluble in 3:1 $HCl:H_2NO_3$.

4) The solid is weighed in trays and subsequently dried at 105° C. for 24 hours.

5) After cooling, the weight of the solid is recorded.

6) The final solid is put in a bottle suitable for further ICP analysis of iron, alumina, phosphorous and silicate and particle size distribution. It is then separated for making the pulp to be used in the flotation test.

Using a calibrated pH meter, a make-up water (to keep the level of the recipient of the flotation cell constant) is prepared by adjusting its pH (for example to pH 10.5 with NaOH 5% or acetic acid 10%) to a desired value.

The collector solution of amine, for example an ether amine (concentration is, for example, 1 wt %), is prepared as well as the depressant solution (concentration is, for example, 1 wt %). Preparation of the depressant solution must take into account its moisture and organic content.

The flotation cell (2 L) is weighed and the required amount of pulp for flotation is added as follows: a dry mass of pulp is added, up to its half, completing the other half with the required quantities of collector and depressant solutions and with "water" (liquid) filtered from the sample of the pulp received. (Note: the capacity of the flotation cell is measured up to the height of the blades.) The addition of these materials is made as follows:

1) The "water" volume needed for sample homogenization is added.

2) The extractor is downloaded up to the limit, switching on the rotation (950 rpm). The initial pH is measured and recorded.

3) The mass of depressant solution is added in and conditioned and/or agitated for a period of time, for example 5 minutes, observing the pH. If the pH stabilizes at a desired value (for example 10.5), no adjustment is needed. Otherwise, pH modifiers (for example 5% NaOH and/or acetic acid solution 10%) may be added to adjust the pH to the desired value.

After the conditioning and/or agitation and if necessary, pH adjustment, the mass of amine collector solution is added to the recipient vessel and the remaining volume of the tank is completed with remaining calculated "water" from the sample, for a given pulp solids %. This mixture is conditioned or agitated for a period of time, for example 1 minute. Collection trays are weighed and their weighs recorded.

With the flotation cell and the collection trays put together, maximum aeration and collecting shovels are switched on, starting to count the timing of flotation (chosen according to each test). The level of recipient is kept constant by the use of make-up water, already prepared previously with a desired pH, for example a pH of 10.5.

At the end of the test, the flotation cell is cleaned taking the necessary care for no contamination of the materials floated and sunk.

The floated (gangue) and sunk (concentrate) materials are collected in the weighed trays during the time chosen for collection. The samples are subsequently dried at 105° C.

The trays containing the float and sunk materials are weighed and recorded. A quantity of each material is sent for analysis of iron, silica, alumina and phosphorus.

Example 1

Flotation Test with High Grade Iron Ore and Exemplary Depressant Comprising Xylan In this example, flotation tests were conducted on a laboratory scale and the objective of these tests were to separate the mineral of interest (hematite) from gangue. The general protocol for flotation tests as described above was used for these experiments. The depressant used for these experiments was a blend of polysaccharides present in plant cell walls comprising mainly xylan (labeled KEMXMC) or starch (for example corn or tapioca starch). In this raw iron ore sample, the values of iron and silicate were 59.7% (59.61% and 59.88%) and 13.0% (13.43% and 12.66%) respectively.

Figure 2:
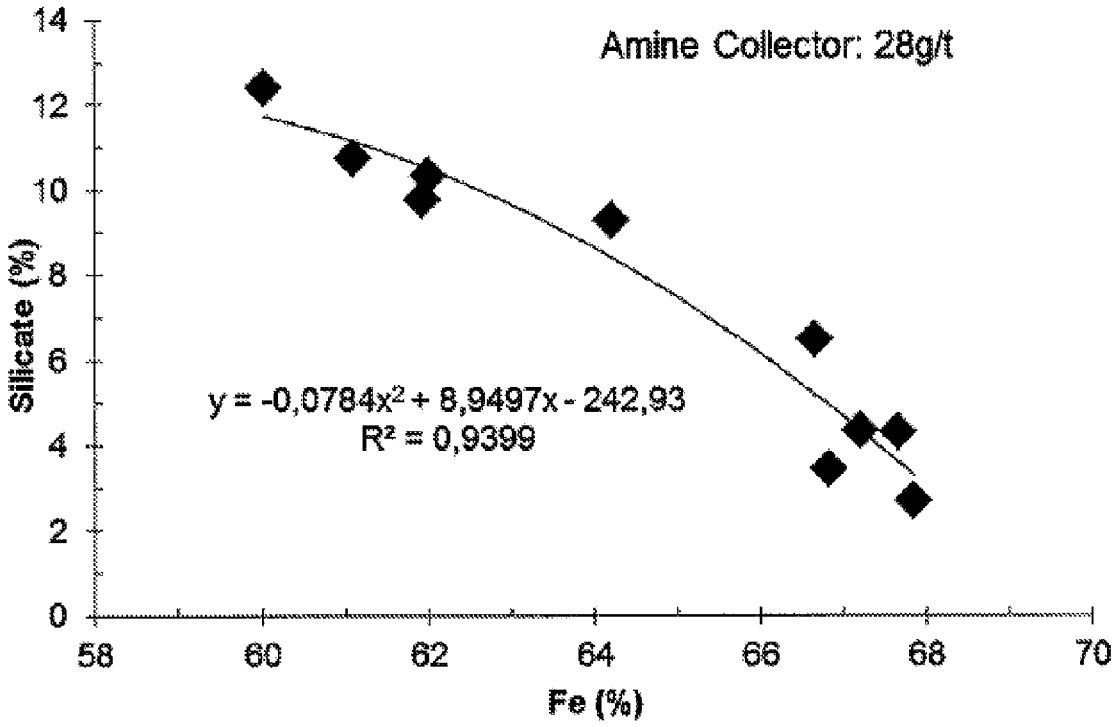
FIG. 2 is a graph of which shows the correlation of iron and silicate in the fraction concentrate.
Figure 3:
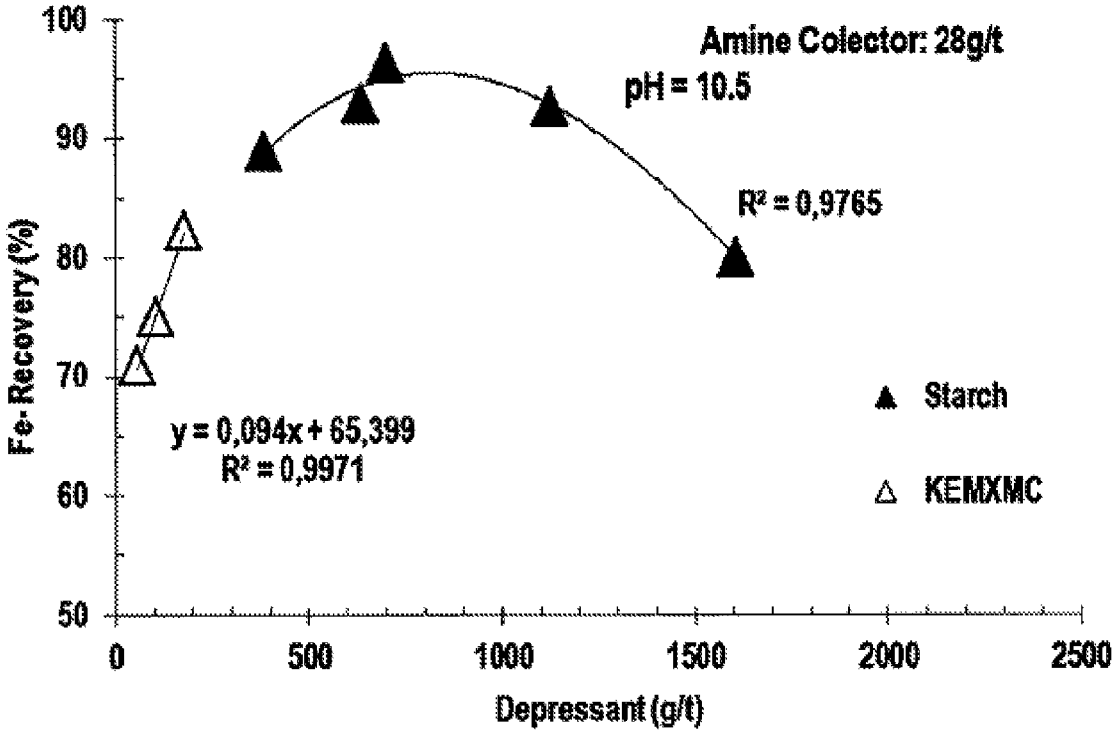
FIG. 3 shows the effect of the depressant amount on the metallurgic recovery for KEMXMC and starch.
Figure 4:
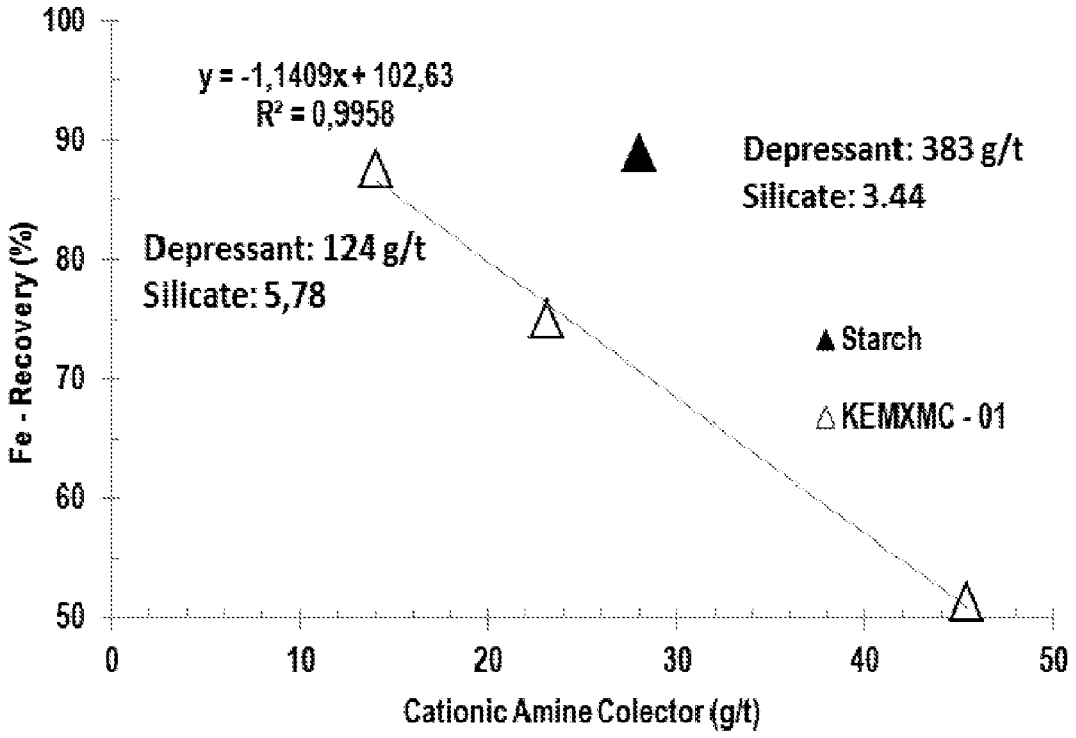
FIG. 4 shows the effect of the collector amount on the metallurgic recovery for KEMXMC and starch.

It was observed that the KEMXMC depressant, when used in the flotation tests, performed comparably or better than starch. At depressant concentrations of less than 200 g/T, KEMXMC increased iron concentration in the final sample compared to processes with similar amounts of starch (see FIG. 1). Smaller amounts of silicate were also observed in the samples which were produced by processes utilizing KEMXMC compared to starch (see FIGS. 1 and 2). It was also observed that metallurgic recovery was increased (see FIG. 3), and the amount of collector needed was decreased (see FIG. 4) when KEMXMC was used in place of starch in the flotation test.

Example 2

Flotation Test with High Grade Iron Ore and Exemplary Depressant Comprising Xylan from Sugar Cane Bagasse or Corn Fiber Residue In this example, flotation tests were conducted on a laboratory scale and the objective of these tests were to separate the mineral of interest (hematite) from gangue. The depressant used for these experiments was a blend of polysaccharides present in plant cell walls comprising mainly xylan (labeled KEMXMC) or starch (for example corn or tapioca starch). The source of the xylan was sugar cane bagasse (ca. 20% over dry base) or corn fiber residue (ca. 20-30% over dry base). Chemical analysis of the iron ore sample was by X-ray fluorescence and the results are provided in Table 1.

TABLE 1

Chemical Analysis of High Grade Iron Ore

| Substance | Weight % |
|---|---|
| Fe | 65.1 |
| $SiO_2$ | 5.24 |
| $Al_2O_3$ | 0.87 |
| P | 0.03 |
| Mn | 0.18 |
| TiO2 | 0.14 |
| CaO | <0.10 |
| MgO | <0.10 |

The general protocol for flotation tests as described above was used for these experiments. The specific parameters for the experiments are provided in Table 2.

TABLE 2

Flotation Test Parameters for High Grade Iron Ore and Exemplary Depressants or Starch

| Depressant Type | Starch | KEMXMC |
|---|---|---|
| Depressant Amount (g/ton) | 700 | 700 |
| Collector Amount (g/ton) | 28 | 3 |
| pH | 10.5 | 9.5 |
| Time (min) | 5 | 5 |
| Agitation (rpm) | 1100 | 1100 |
| Fe in Concentrate (wt %) | 68.2 | 68.2 |
| $SiO_2$ in Concentrate (wt %) | 2.53 | 2.64 |
| Fe Recovery (%) | 97.33 | 99.96 |

Example 3

Flotation Test with Low Grade Iron Ore and Exemplary Depressant Comprising Xylan from Sugar Cane Bagasse or Corn Fiber Residue In this example, flotation tests were conducted on a laboratory scale and the objective of these tests were to separate the mineral of interest (hematite) from gangue. The depressant used for these experiments was a blend of polysaccharides present in plant cell walls comprising mainly xylan (labeled KEMXMC1 or KEMXMC2) or starch (for example corn or tapioca starch). The source of the xylan was sugar cane bagasse (ca. 20% over dry base) or corn fiber residue (ca. 20-30% over dry base). Chemical analysis of the iron ore sample was by X-ray fluorescence and the results are provided in Table 3.

TABLE 3

Chemical Analysis of High Grade Iron Ore

| Substance | Weight % |
|---|---|
| Fe | 50.9 |
| $SiO_2$ | 24.8 |
| $Al_2O_3$ | 0.14 |
| P | 0.07 |
| Mn | 0.10 |
| TiO2 | <0.10 |
| CaO | <0.10 |
| MgO | <0.10 |

The general protocol for flotation tests as described above was used for these experiments. The specific parameters for the experiments are provided in Table 4.

TABLE 4

Flotation Test Parameters for Low Grade Iron Ore and Exemplary Depressants or Starch

| Depressant Type | Starch | KEMXMC1 | KEMXMC2 |
|---|---|---|---|
| Depressant Amount (g/ton) | 1200 | 2000 | 600 |
| Collector Amount (g/ton) | 32 | 32 | 32 |
| pH | 10.5 | 10.5 | 10.5 |
| Time (min) | 3 | 3 | 3 |
| Agitation (rpm) | 950 | 950 | 950 |
| Fe in Concentrate (wt %) | 67.77 | 67.93 | 61.60 |
| $SiO_2$ in Concentrate (wt %) | 1.23 | 1.26 | 10.41 |
| Fe Recovery in Concentrate (%) | 79.18 | 92.11 | 98.22 |
| Fe in Gangue (wt %) | 23.88 | 13.27 | 8.17 |

In the preceding procedures, various steps have been described. It will, however, be evident that various modifications and changes may be made thereto, and additional procedures may be implemented, without departing from the broader scope of the exemplary procedures as set forth in the claims that follow.

We claim:

1. A composition comprising:

a depressant comprising one or more types of polysaccharides comprising one or more types of pentosan units, wherein the one or more types of polysaccharides are derived from corn, corn fiber residue or corn-plant cell walls;

an iron-containing mineral; and a solvent.

2. The composition of claim 1, wherein the solvent is water.

3. A process for enriching a desired mineral from an ore comprising the desired mineral and gangue, wherein the process comprises carrying out a flotation process in the presence of one or more collecting agents and one or more depressants, and wherein at least one of the one or more depressants comprises one or more types of polysaccharides comprising one or more types of pentosan units;

wherein the one or more types of polysaccharides are derived from corn, corn fiber residue or corn-plant cell walls; and wherein the desired mineral is an iron-containing mineral.

4. The process of claim 3, wherein the gangue comprises oxides of silica, silicates or siliceous materials.

5. The process of claim 3, wherein the flotation process is a reverse cationic flotation process.

6. The process of claim 3, wherein the one or more depressants is added in the form of a composition comprising the depressant and a solvent.

7. The process of claim 6, wherein the solvent is water.

* * * * *